US010016690B2

(12) United States Patent
Zamperla

(10) Patent No.: US 10,016,690 B2
(45) Date of Patent: Jul. 10, 2018

(54) VEHICLE FOR ROTATING CAROUSEL

(71) Applicant: ANTONIO ZAMPERLA S.p.A., Altavilla Vicentina (IT)

(72) Inventor: Alberto Zamperla, Altavilla Vicentina (IT)

(73) Assignee: ANTONIO ZAMPERLA S.P.A., Altavilla Vicentina (IT)

( * ) Notice: Subject to any disclaimer, the term of this patent is extended or adjusted under 35 U.S.C. 154(b) by 0 days.

(21) Appl. No.: 15/525,971

(22) PCT Filed: Nov. 17, 2015

(86) PCT No.: PCT/IB2015/058874
§ 371 (c)(1),
(2) Date: May 11, 2017

(87) PCT Pub. No.: WO2016/079666
PCT Pub. Date: May 26, 2016

(65) Prior Publication Data

US 2017/0312641 A1 Nov. 2, 2017

(30) Foreign Application Priority Data

Nov. 17, 2014 (IT) ..... MI2014A1981

(51) Int. Cl.
*A63G 1/10* (2006.01)
*A63G 1/30* (2006.01)

(52) U.S. Cl.
CPC ..... *A63G 1/30* (2013.01)

(58) Field of Classification Search
CPC ... A63G 1/00; A63G 1/10; A63G 1/12; A63G 1/22
USPC ..... 472/29–34
See application file for complete search history.

(56) References Cited

U.S. PATENT DOCUMENTS 4,246,848 A * 1/1981 Schneider ..... B61B 12/028 104/173.2
5,378,214 A * 1/1995 Kreitenberg ..... A63B 21/0125 472/21
5,935,011 A * 8/1999 Morgan ..... A61G 3/061 414/462
6,340,280 B1 1/2002 Mollick et al.
(Continued)

FOREIGN PATENT DOCUMENTS

CN 201108737 9/2008
DE 4235793 4/1994
EP 1034823 9/2000
(Continued)

OTHER PUBLICATIONS

International Search Report of PCT/IB2015/058874 dated Mar. 4, 2016.
(Continued)

*Primary Examiner* — Kien Nguyen

(57) ABSTRACT

A vehicle (6) for rotating carousel (1) is described, comprising means (8) movable by at least one passenger at a detectable speed, means (13) for detecting said speed of said movable means (8) and generating a corresponding signal and means (14, 15) for controlling the lifting of the vehicles (6) as a function of the activation and/or the speed of the movable means (8), characterized in that said movable means (8) are hand-operable means (8).

13 Claims, 9 Drawing Sheets

(56) References Cited

U.S. PATENT DOCUMENTS 6,342,013 B1 * 1/2002 Irelan ..... A63G 1/16
472/14

FOREIGN PATENT DOCUMENTS

WO 2008059356 5/2008
WO WO 2008/059356 * 5/2008 ..... A63G 1/10

OTHER PUBLICATIONS

International preliminary report on patentability issued for PCT/IB2015/058874 dated May 23, 2017.

* cited by examiner

VEHICLE FOR ROTATING CAROUSEL

RELATED APPLICATIONS

This application is the U.S. national phase application of international application number PCT/IB2015/058874, filed 17 Nov. 2015, which designates the U.S. and claims priority to Italian application MI2014A001981 filed 17 Nov. 2014, the contents of each of which are hereby incorporated by reference as if set forth in their entireties.

FIELD OF THE INVENTION

The present invention relates to a vehicle for a rotating carousel.

BACKGROUND OF THE INVENTION

Rotating carousels are known in the art, i.e. revolving rides provided with arms carrying at each end a vehicle able to accommodate one or more passengers. The arms carrying the vehicle are activated by pneumatic or hydraulic means lifting and lowering back the arm and the vehicle, automatically or upon a passenger command. EP 1034823 describes a single amusement device comprising a seat for accommodating a child, two bicycle pedals and means for measuring the rotational speed and accordingly activating, in an on-off manner, a seat lifting device that is substantially the identical to the lifting devices used for moving pallets and the like. In other words, EP 1034823 only allows vertically lifting a single seat with the child along a frame and rotating the seat supporting platform on itself.

FR-A-2618690 describes a device simulating the flight and that, among the various shown embodiments, comprises the possibility for the user of activating a propeller by means of foot pedals. Such an implementation has the disadvantage of connecting the vehicle elevation to the foot pedals motion so that the elevation relies upon the muscular force of the passenger.

WO2008/059356, in the name of the present Applicant, describes a rotating carousel in which vehicles are provided with pedals or other means operable by a passenger at a detectable speed, means for detecting said speed of said movable means and generating a corresponding signal and means for controlling the activation of the cylinders for lifting the arms as a function of the generated signal. Since the generated signal is in its turn a function of the pedal (or other means) speed, WO2008/059356 allows releasing the lifting of the arms and vehicles present on the arms from the exerted muscular force.

The solutions shown in WO'356, including the vehicles, are however poorly suited if the passengers for the carousel are disabled, i.e. handicapped people suffering from motor impairment.

SUMMARY OF THE INVENTION

Object of the present invention is to solve the above mentioned problems and allow disabled passengers being carried in at least one vehicle of a rotating carousel and wherein they can interact with the latter in order to control the elevation of the vehicle with their own physical activity.

Such an object is reached by means of the present invention concerning a vehicle for rotating carousel, comprising means movable by at least one passenger on the vehicle at a detectable speed, means for detecting said speed of said movable means and generating a corresponding signal and means for controlling the lifting of the vehicles as a function of the activation and/or the speed of the movable means, characterized in that said movable means are hand-operable means.

In a preferential embodiment, the rotary movable means more preferably comprise two discs provided with a crank and mounted on a support; according to an aspect of the invention, the support is fastened on the vehicle by means for adjusting the height of the hand-operable means with respect to the vehicle floor. Preferably, the support has a curved rod shape, the rod being pivoted to the front part of the vehicle and extending towards the part of the vehicle carrying the seats once switched to operative condition.

In an embodiment of the invention, the curved support carrying the hand-operable means is pivoted to the vehicle structure and the means for adjusting the height of the support—and thus of the hand-operable means—connect a point of the curved support to the vehicle structure. In an embodiment, the piston and cylinder device is used for controlling the position of the hand-operable means that are in particular provided with a crank, with respect to the vehicle.

For this purpose different embodiments are possible: preferably the piston device is a gas spring normally holding the curved support in a lifted condition and being provided with a stop element to restraining and releasing the spring and, consequently, stop the curved support and the cranks in the position desired by the user. The stop element is controlled by the user, for example by a lever.

Other known means for adjusting the height of the support are possible, for example the piston can exert friction on the inner walls of the cylinder or, alternatively, the piston can be of the type in which the two cylinder chambers are provided with a fluid (for example oil or gas) and are connected one to another. In this case, the fluid passage from a chamber to the other one counteracts the piston movement inside the cylinder.

According to another aspect of the invention, the means for detecting the speed at which the movable means are activated, for example the two discs provided with a crank, comprise a pierced disc integral with one of the rotatable discs and a sensor adapted to detect the rotation of the pierced disc and generate pulses. In an embodiment, pierced disc and sensor are part of a phonic wheel.

According to another aspect of the present invention, the hand-operable means are provided with an adjustable brake acting on at least one of the discs for adjusting the activation speed thereof.

According to a further preferential aspect of the invention, the vehicle comprises a platform for housing a wheelchair and a seat; alternatively, the platform can comprise two seats, preferably one of the seats is provided with an anti-decubitus cushion.

BRIEF DESCRIPTION OF THE FIGURES

These advantages will be further evident from the following description and the attached drawings made for illustration purposes and without limitation, in which.

MODES FOR IMPLEMENTING THE INVENTION

Figure 1:
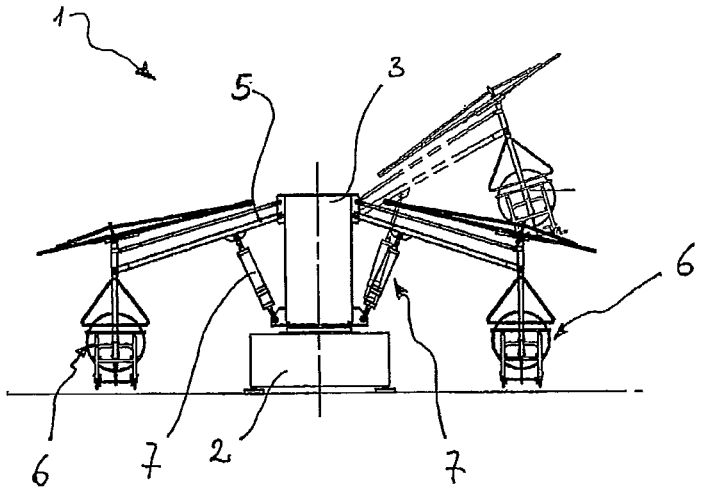
FIGS. 1 and 2 are respectively front and top views of a rotating carousel adapted for housing the vehicle according to the present invention.
Figure 2:
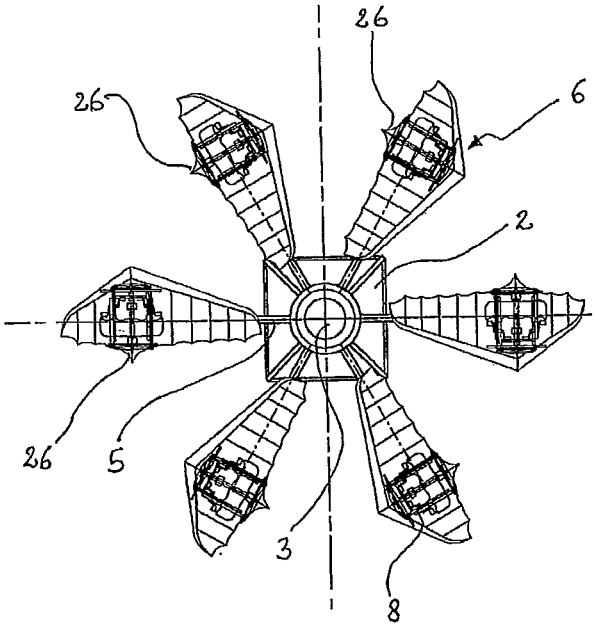

In FIGS. 1 and 2 a device of the rotating carousel type is shown, similar to the device described in WO2008/059356 (in the name of the present Applicant) wherein the device 1 comprises a central structure composed of a base 2 and a rotating portion 3. The rotating portion 3 comprises part of the pneumatic or hydraulic system and a plurality of supporting arms 5 of a corresponding plurality of vehicles 6. A cylinder 7 per each arm 5, having the shape of a double-chamber cylinder, is present for the activation of said arms 5.

For a more detailed description of the operation and structure of the rotating carousel 1, reference should be made to the description of WO'356. It has to be observed that the vehicle 6 according to the present invention can be connected to any type of rotating carousel, therefore the rotating carousel 1 described in WO'356 has been considered for illustrating only one of the possible embodiments of the present invention.

Figure 3:
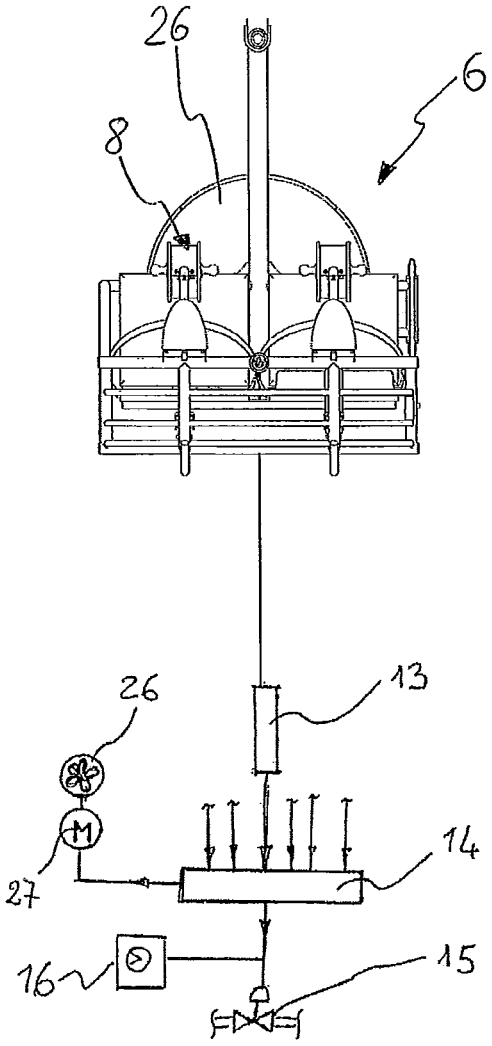
FIG. 3 is an operating scheme of the rotating carousel adapted for housing the vehicle according to the present invention.

FIG. 3 shows an embodiment of the vehicle 6 according to the present invention, comprising means 8 movable by at least one passenger present on the vehicle 6 at a detectable speed and means 13 for detecting the speed of the movable means 8 and generating a corresponding signal. The vehicle 6 further comprises means 14, 15 for controlling the lifting of the vehicles 6 as a function of the activation and/or the speed of the movable means 8. The means 14, 15 comprise a controlling unit 14 adapted to receive the signal generated by the means 13 for detecting the speed of the movable means 8. The controlling unit 14 controls the opening and closing of at least one electrovalve 15 in order to supply a fluid into the cylinder 7 so that to lift the vehicle 6 as a function of the activation and/or the speed of the movable means 8. For a more detailed description of the means 14, 15 for controlling the lifting of the vehicles 6 reference should be made to the description of WO'356.

Figure 4:
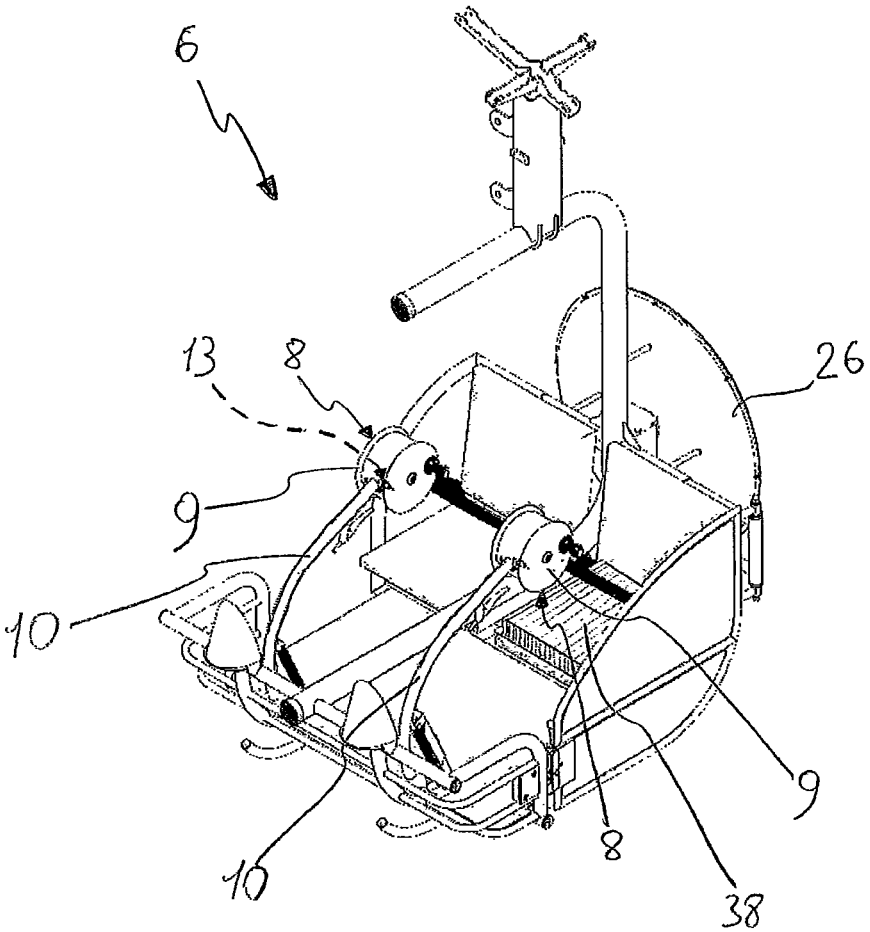
FIG. 4 is a perspective view of an embodiment of the vehicle according to the present invention.

The movable means 8 of the vehicle 6 according to the present invention are characterized by being hand-operable means. Referring to FIG. 4, the vehicle 6 preferably comprises two seats, each of which is adapted to accommodate a passenger. In front of at least one of the seats there movable means 8 arranged such that the passenger can activate them by means of at least one hand.

In the embodiment shown in figures, the movable means 8 comprise two discs 9 provided with a crank and mounted on a supporting element 10. Such a supporting element 10 preferably has a curved-rod shape extending from a first end 10A pivoted to the front part of the vehicle 6 at a second end 10B facing towards the seats and on which the movable means 8 are mounted.

Figure 5A:
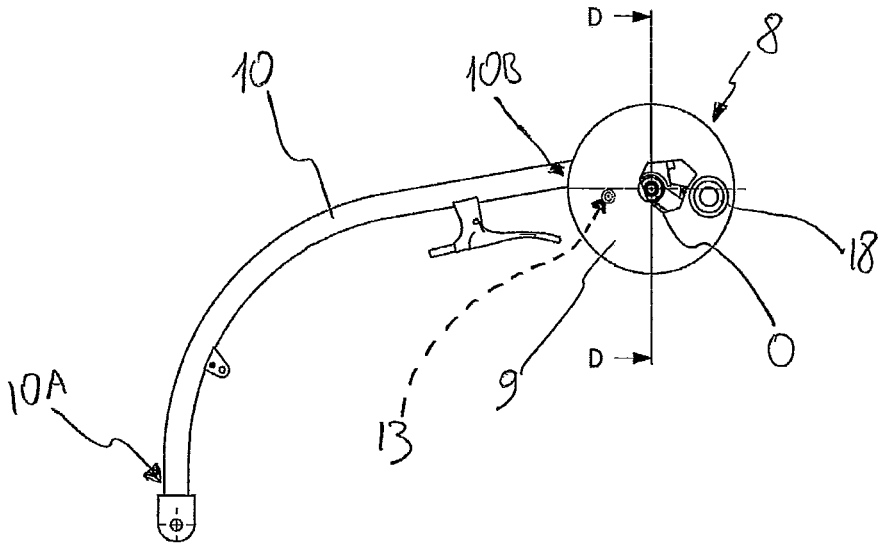
FIG. 5A is a side view of an embodiment of the movable means of the vehicle according to the present invention.

In FIG. 5A the movable means 8 are shown, mounted on the supporting element 10 disconnected from the vehicle 6. The movable means 8 are of rotary type and comprise two discs 9 provided with a crank which are arranged parallel one to another and rotatable around a common rotation axis R-R visible from the sectional view of FIG. 5B. The rotation axis R-R preferably passes through both the centers O of each disc 9. Preferably each of the discs 9 has a through-hole at the center O, thus by means of a pin 11 constrained (by means of screws 12 or similar means known in the art) to the two discs 9 at the centers O, the two discs are integral with one another.

The pin 11 is housed inside a bearing 17 whose outer walls are constrained to the end 10B of the support 10.

Every disc 9 comprises a crank 18. The cranks 18 are preferably arranged in phase opposition, i.e. during the rotation of the discs 9 the two cranks 18 are in diametrically opposite positions. Further embodiments are however provided, in which the cranks 18 can be arranged phased or phase-shifted by an angle smaller than 180°, while still falling in the protection scope of the present invention.

Figure 5B:
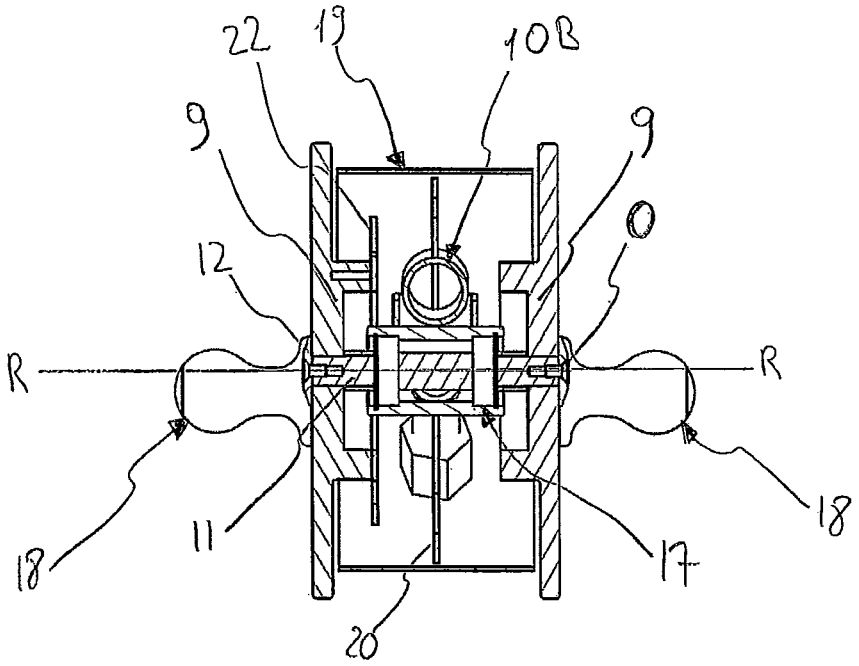
FIG. 5B is a sectional view according to the cut plane D-D of the movable means shown in FIG. 5A.
Figure 6:
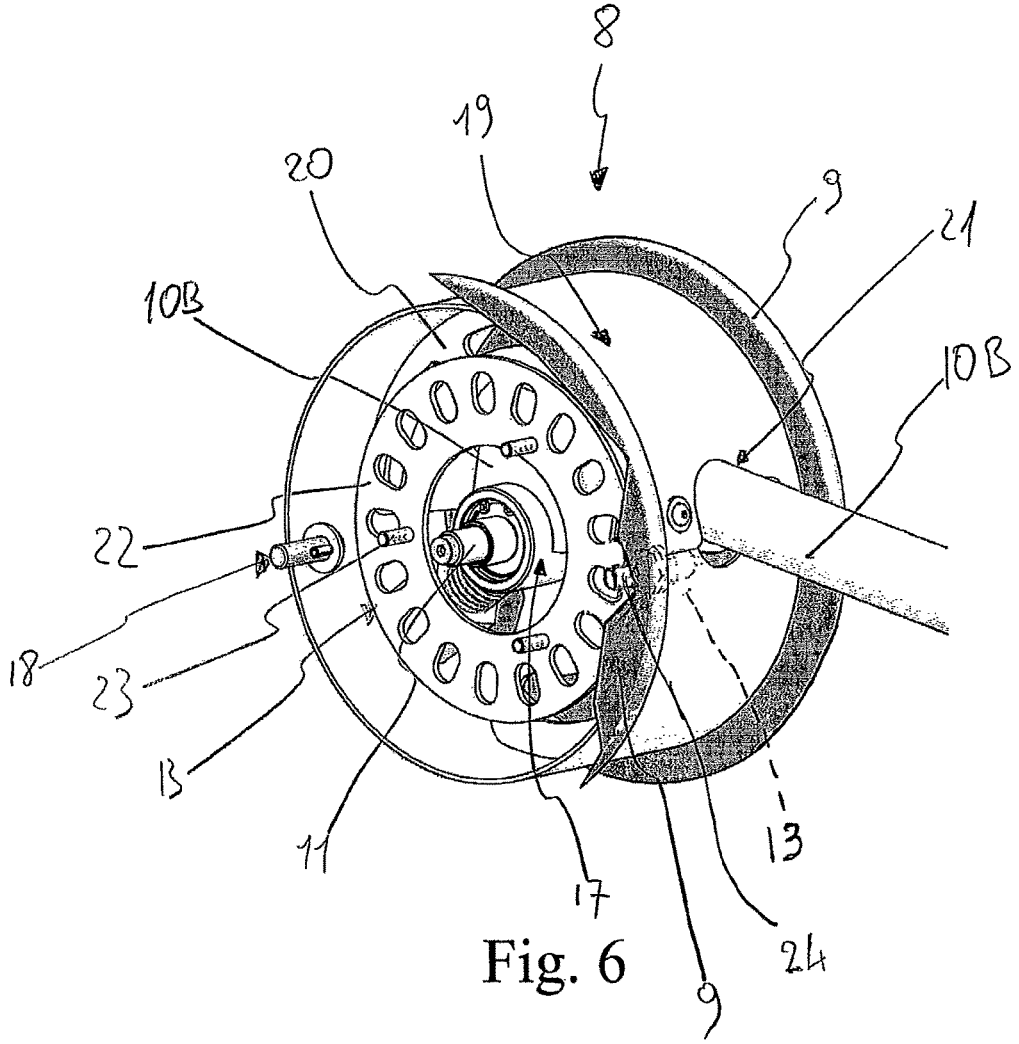
FIGS. 6 and 7 are cut-away perspective views of an embodiment of the movable means according to the present invention.

Referring to FIGS. 5B and 6, the movable means 8 preferably comprise a cylinder casing 19 interposed between the discs 9. The casing 19 is preferably spaced apart from the bearing 17 by means of a flange 20 constrained to the outer walls of the bearing. The casing 19 has an opening 21 surrounding the end 10B of the supporting element 10 concealing the inside of the movable means 8. The casing 19 not contacting the discs 9 is not subjected to the rotation of the discs 9. The casing 19 can be preferably tape-shaped and wrapped around the flange 20 of the means 8, whose flange is integral with the support 10. Thus, by fastening the ends of the casing one to another, a cylinder constrainable to the ends 10B of the support 10 is obtained.

In a preferential embodiment, the movable means 8 can comprise an adjustable brake (not shown) acting on at least one of the discs 9 for adjusting the activation speed thereof. Preferably, the brake acts when the disc speed is higher than an established safety speed by keeping down the rotation speed of the means 8.

As described above, the movable means 8 comprise means 13 for detecting the rotation speed of the movable means 8. In FIG. 6 a particular embodiment of the means 13 for detecting the speed of the movable means 8 is shown. In particular, the means 13 comprise a pierced disc 22 integral with one of the two discs 9 by means of pins 23 or similar means per se known in the art. In FIG. 6 the disc 9, on which the pierced disc 22 is integrally constrained, has been depicted partially clear (cut-away view) in order to render visible the inside of the movable means 8. The means 13 further comprise a sensor 24 adapted to detect a movement of the pierced disc 22.

Figure 7:
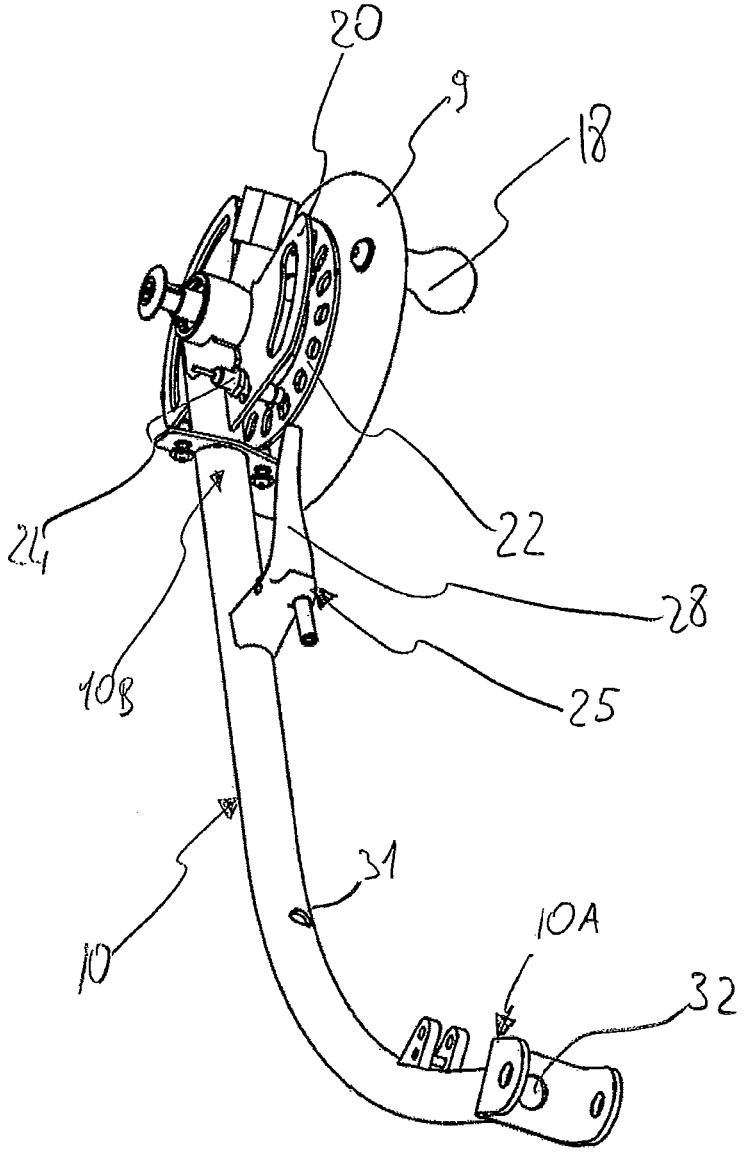

In FIG. 7 the sensor 24 constrained to the flange 20 is more clearly shown. The sensor 24 is preferably a proximity sensor (for example of inductive type) able to detect the presence or absence of an object inside its own nominal range. Preferably, the output electric signal of the sensor will be of on/off type since it has to denote only the presence/absence conditions.

In the particular embodiment shown in the figures, the sensor 24 is arranged so that the responsive side is facing towards the pierced disc 22. A rotation of the disc 9, that causes a rotation of the pierced disc 22, is detected by the sensor 24 as an alternation of absence/presence conditions due to the alternation of full and pierced parts passing in front of the responsive side of the sensor 24. The signal generated by the means 13 is preferably formed by a pulse train (for example a square wave) having a frequency proportional to the angular velocity of the pierced disc 22 and thus the discs 9 (the pierced disc 22 being integral with the disc 9).

In general, the means 13 for detecting the speed of the movable means 8 can comprise a phonic wheel 22 either of inductive or capacitive or magnetic or optic type, for example, and a sensor 24 combined with the type of phonic wheel adapted to detect the angular velocity of the phonic wheel 22.

Preferably, the means 14, 15 control the lifting of the vehicles 6 as a function of the activation of the movable means, i.e. the lifting of the vehicle 6 is actuated at a constant speed at least when the means 13 detect a rotation of the movable means 8.

Characteristic aspect of the present invention is that the passenger can be a disabled with particular movement difficulties. Thus, in order to promote the lifting of the vehicles 6 also for people with movement impairment, the means 14, 15 can advantageously control the lifting of the vehicle 6 also for short rotations of the movable means 8. In the preferential embodiment of the invention, in absence of signal, the vehicle slowly descends.

In other implementations similarly to the system described in WO'356, the valve closure can be controlled also by a timer (shown in FIG. 3) that provides maintaining the fluid supply to the cylinder 7 for an established period of time, even after the absence of the signal generated by the means 13 below a pre-established threshold value.

Figure 8:
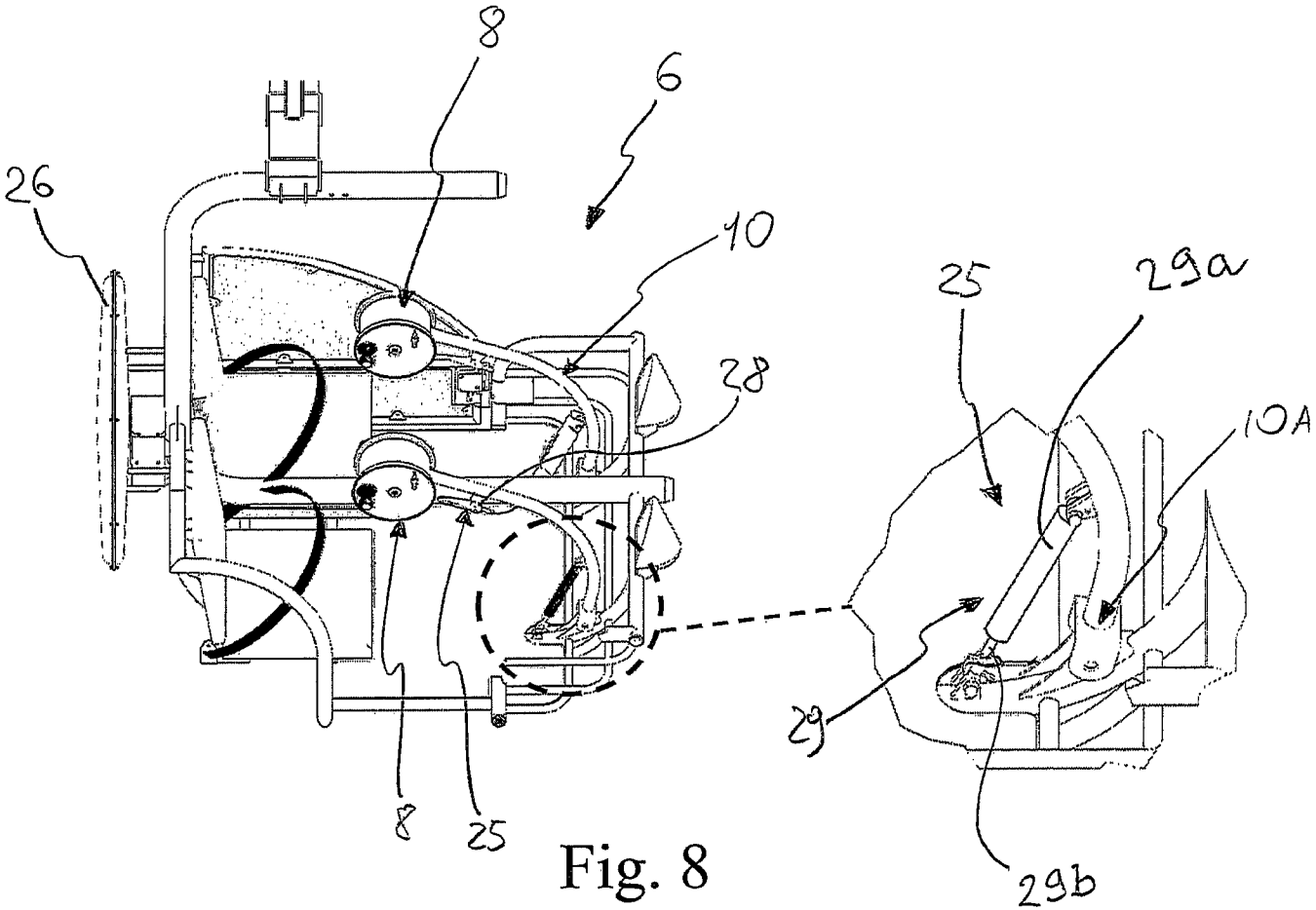
FIG. 8 is a perspective view of an embodiment of the means for adjusting the height and/or position of the movable means according to the present invention.

The controlling unit 14 can in addition control the activation of a further element (if present); in this case, the element is a propeller 26 operated by a motor 27 for a better simulation of the "flight" speed of the vehicle; the rotation speed of the propeller, by the motor, preferably depends on the actuation speed of the cranks of the means 8. Referring to FIG. 8, the vehicle 6 according to the present invention further comprises means 25 for adjusting the height and/or position of the movable means 8. As described above, the end 10A of the support 10 is pivoted to the front part of the vehicle 6. The support 10 is further fastened to the vehicle 6 by the means 25 for adjusting the height and/or position of the movable means 8 with respect to the seat of the vehicle 6. The means 25 comprise means 28 urging said support towards a rest position P1, and a stop device 29 for restraining the support 10 in a work position P2, in which the hand-operable means 8 can be accessed by a passenger.

Figure 9:
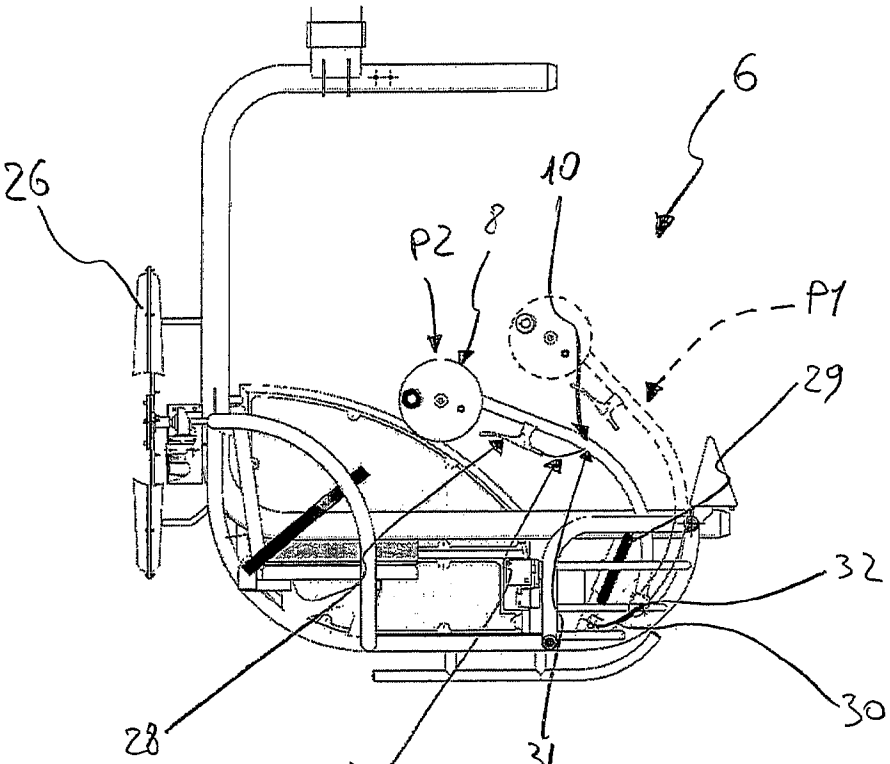
FIG. 9 is a side view of an embodiment of the means for adjusting height and/or position of the movable means of FIG. 8.

In FIG. 8 an enlargement of the front part of the vehicle 6 (enclosed by a dotted circle) in which the end 10A of the support 10 is pivoted, is shown. In this embodiment the stop device 29 is a gas spring comprising a cylinder 29*a* pivoted at the end 10A of the support and a piston 29*b* pivoted to the front part of the vehicle 6 at the point pivoting the support 10 to the front part of the vehicle 6. The stroke of the piston 29*b* can be restrained in any position in a way known in the art, for example thanks to a push button (not shown) located at the piston 29*b* acting on a valve (not shown) inserted in the cylinder 29*a*. The push button is activated by the means 28 that, in the particular shown embodiment, are shaped as a lever located at the end 10A of the support 10 so as to be accessible to the passenger. The operation of the lever 28 is similar to that of a bicycle brake lever. In particular by means of the lever 28 a cable 30, generally inserted inside a sheath, can be pulled and released. The cable 30 connects the lever 28 to the push button of the gas spring 29, the push button being adapted to close and open the valve located inside the cylinder 29*a*. The cable and sheath preferably pass inside the support 10 by means of an inlet hole 31 and an outlet hole 32 (visible for example in FIG. 7). In FIG. 9 the cable 30 and two positions P1 and P2 taken by the support 10, are visible.

By pressing the lever 28 the passenger, or anyone else, pulls the cable that releases the gas spring, thereby allowing the adjustment of the height and/or position of the means 8 with respect to the seat. Therefore, for example starting from a rest position P1 (shown in dotted line) in which the passenger is facilitated to enter the vehicle 6, by pushing on the lever 28 the support can be switched to an operative position P2 suited for the passenger height. By releasing the lever 28 the position P2 is held by means of the gas spring whose valve is closed upon the release of the lever 28.

Figure 10:
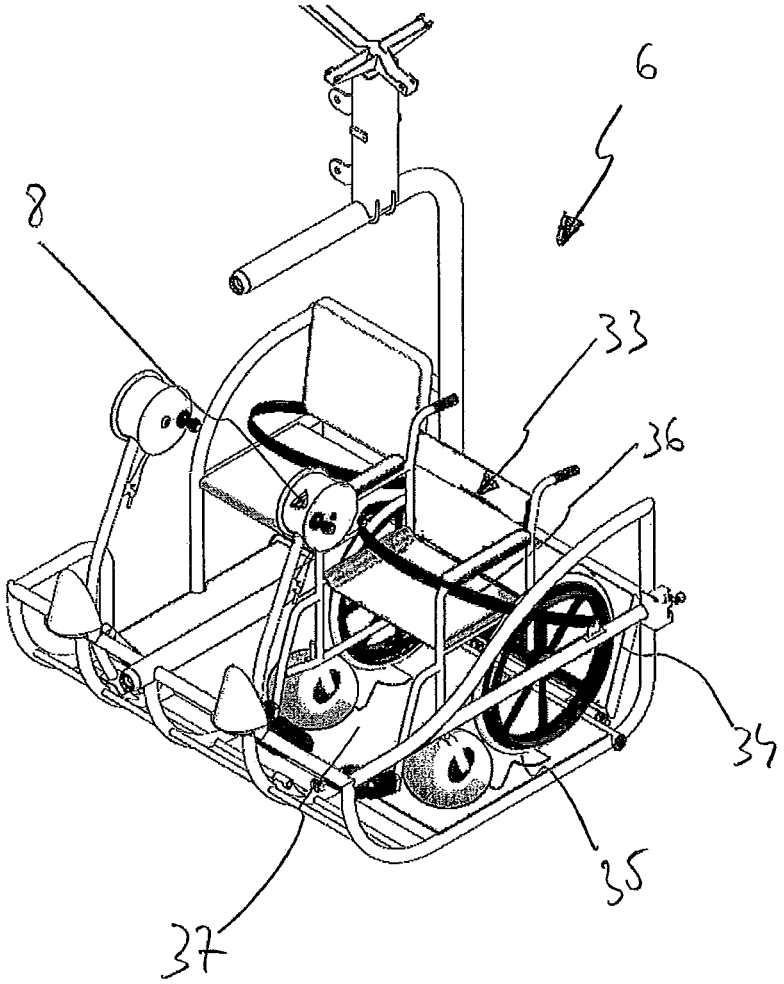
FIG. 10 is a perspective view of a further embodiment of the vehicle according to the present invention.

In FIG. 10 a further embodiment of the vehicle 6 is shown according to the present invention, wherein instead of one of the seats there is a platform 37 adapted to house a wheelchair 33. The wheelchair 33 can thus be loaded on the platform 37 by means of a chute 34 also acting as a door. Thus, once the wheelchair has been loaded inside the vehicle, by closing the chute (i.e. the door) the wheelchair can be safely constrained by means of stops 35 and safety belts 36.

The vehicle 6 can have, in one or more seats, an anti-decubitus cushion 38 visible for example in FIG. 4.

The invention claimed is:

1. Vehicle for a rotating carousel, the vehicle comprising a motion control device hand-operable by at least one passenger at a detectable speed, means for detecting said speed and for generating a corresponding signal, and means for controlling lifting of the vehicle as a function of at least one of activation of the motion control device and the speed, wherein said motion control device includes a rotatable portion and is mounted on a supporting element, said supporting element being coupled to the vehicle by an adjustment member for adjusting height and/or position of said motion control device with respect to the vehicle.

2. The vehicle according to claim 1, wherein said motion control device comprises two discs, each including a crank.

3. The vehicle according to claim 2, wherein one of said two discs is integral with an additional pierced disc inside said motion control device, and further comprising a sensor adapted to detect a movement of said pierced disc.

4. The vehicle according to claim 1, wherein the supporting element is a curved rod pivotally connected to a front part of the vehicle and extending towards an opposite side of the vehicle.

5. The vehicle according to claim 1, wherein the vehicle includes a platform for housing a wheelchair or other vehicle for a disabled passenger.

6. The vehicle according to claim 1, further comprising a motor-operable propeller disposed on the vehicle.

7. The vehicle according to claim 6, wherein the propeller is operable as a function of the speed of the motion control device.

8. The vehicle according to claim 1, wherein said motion control device comprises two discs, each including a crank.

9. A vehicle for a rotating carousel, the vehicle comprising a motion control device hand-operable by at least one passenger at a detectable speed, means for detecting said speed and for generating a corresponding signal, and means for controlling lifting of the vehicle as a function of at least one of activation of the motion control device and the speed, further comprising a support element coupling the motion control device to the vehicle, and components for adjusting height and/or position of the motion control device, said components including a lever for urging said support element towards a rest position and a stop device for restraining said support element in a work position.

10. The vehicle according to claim 9, wherein said components for adjusting height and/or position comprise a gas spring.

11. A vehicle for a rotating carousel, the vehicle comprising:

a motion control device that is hand-operable by at least one passenger at a detectable speed, the motion control device including a rotatable portion including two discs, each including a crank, and the motion control device being mounted on a supporting element;

means for detecting said speed and for generating a corresponding signal; and means for controlling vertical position of the vehicle as a function of at least one of activation of the motion control device and the speed, said supporting element being a curved rod pivotally connected to a front part of the vehicle by an adjustment member for adjusting height and/or position of the motion control device with respect to the vehicle.

12. The vehicle according to claim 11, wherein said adjustment member includes a lever for urging said supporting element towards a rest position and a stop device for restraining said supporting element in a work position.

13. The vehicle according to claim 12, wherein said adjustment member further includes a gas spring.

* * * * *